US008054247B2

(12) United States Patent
Ryu et al.

(10) Patent No.: US 8,054,247 B2
(45) Date of Patent: Nov. 8, 2011

(54) DRIVING METHOD OF A DISPLAY

(75) Inventors: Do Hyung Ryu, Suwon-si (KR); Do Ik Kim, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1111 days.

(21) Appl. No.: 11/892,478

(22) Filed: Aug. 23, 2007

(65) Prior Publication Data

US 2008/0055206 A1 Mar. 6, 2008

(30) Foreign Application Priority Data

Aug. 30, 2006 (KR) ..... 10-2006-0083144

(51) Int. Cl.
*G09G 3/28* (2006.01)

(52) U.S. Cl. ..... 345/60; 345/72

(58) Field of Classification Search ..... 345/60–72
See application file for complete search history.

(56) References Cited

U.S. PATENT DOCUMENTS

| | | | | |
|---|---|---|---|---|
| 6,924,824 | B2 | 8/2005 | Adachi et al. | |
| 7,106,290 | B2 | 9/2006 | Inukai et al. | |
| 7,116,301 | B2 | 10/2006 | Numao | |
| 7,515,126 | B2 | 4/2009 | Senda et al. | |
| 2003/0197667 | A1* | 10/2003 | Numao | 345/82 |
| 2004/0160527 | A1* | 8/2004 | Correa et al. | 348/447 |
| 2005/0046619 | A1 | 3/2005 | Senda et al. | |
| 2005/0052448 | A1 | 3/2005 | Hayafuji et al. | |
| 2006/0017667 | A1 | 1/2006 | Seki et al. | |
| 2006/0114199 | A1 | 6/2006 | Kim | |

FOREIGN PATENT DOCUMENTS

| | | | |
|---|---|---|---|
| CN | 1 450 511 | A | 10/2003 |
| JP | 2002-175039 | | 6/2002 |
| JP | 2002-180264 | | 6/2002 |
| JP | 2004-004501 | A | 1/2004 |
| JP | 2004-013115 | | 1/2004 |
| JP | 2005-099712 | A | 4/2005 |
| JP | 2005-292286 | | 10/2005 |
| KR | 10-2002-0018975 | A | 3/2002 |
| KR | 10-2003-0080148 | | 10/2003 |
| KR | 10-2005-0013975 | | 2/2005 |
| KR | 10-2006-0046711 | A | 5/2006 |
| KR | 10-2006-0053694 | A | 5/2006 |

* cited by examiner

*Primary Examiner* — Ke Xiao
(74) *Attorney, Agent, or Firm* — Lee & Morse, P.C.

(57) ABSTRACT

In a method for driving a display, one frame may be divided into more sub frames than a number of bits of data. A time period of the one frame may be divided into a number of periods corresponding to a number of scan lines multiplied by the number of sub frames. A start position of the sub frames may be set based on a bit weight of the data so that gradations are linearly expressed. Remainders of the sub frames may be obtained by dividing the start position of the sub frames by the number of sub frames. A line number of a scan line to which a scan signal is supplied may be obtained based on the time period of the one frame, the start position of the sub frames, and the number of the sub frames.

20 Claims, 7 Drawing Sheets

FIG. 6

| | 0 | 1H | 2H | 3H | 4H | 5H | 6H | 7H | 8H | 9H | 10H | 11H | 12H | 13H | 14H | 15H | 16H | 17H | 18H | 19H | ··· 3199H |
|---|---|---|---|---|---|---|---|---|---|---|---|---|---|---|---|---|---|---|---|---|---|
| 0 | D1 | | | | | | | | | | | | | | | | | | | | ··· |
| 1 | | | | | | | | | | | D1 | | | | | | | | | | ··· |
| ⋮ | | | | | | | | | | | | | | | | | | | | | ··· |
| 36 | | | | | | | | | D5 | | | | | | | | | | | | ··· |
| 37 | | | | | | | | | | | | | | | | | | | D5 | | ··· |
| ⋮ | | | | | | | | | | | | | | | | | | | | | |
| 106 | | | | | D6 | | | | | | | | | | | | | | | | ··· |
| 107 | | | | | | | | | | | | | | | D6 | | | | | | ··· |
| ⋮ | | | | | | | | | | | | | | | | | | | | | |
| 177 | | | | | | | | | | D7-2 | | | | | | | | | | | ··· |
| Scan driver 178 | | | | | | | | | | | | | | | | | | | | D7-2 | ··· |
| ⋮ | | | | | | | | | | | | | | | | | | | | | |
| 247 | | | | | | | D7-1 | | | | | | | | | | | | | | ··· |
| 248 | | | | | | | | | | | | | | | | | D7-1 | | | | ··· |
| ⋮ | | | | | | | | | | | | | | | | | | | | | |
| 286 | | B | | | | | | | | | | | | | | | | | | | ··· |
| 287 | | | | | | | | | | | | B | | | | | | | | | ··· |
| ⋮ | | | | | | | | | | | | | | | | | | | | | |
| 304 | | | | | | D4 | | | | | | | | | | | | | | | ··· |
| 305 | | | | | | | | | | | | | | | | D4 | | | | | ··· |
| ⋮ | | | | | | | | | | | | | | | | | | | | | |
| 313 | | | | | | | | D3 | | | | | | | | | | | | | ··· |
| 314 | | | | | | | | | | | | | | | | | | D3 | | | ··· |
| ⋮ | | | | | | | | | | | | | | | | | | | | | |
| 317 | | | | D2 | | | | | | | | | | | | | | | | | ··· |
| 318 | | | D0 | | | | | | | | | | | D2 | | | | | | | ··· |
| 319 | | | | | | | | | | | | | D0 | | | | | | | | ··· |

DRIVING METHOD OF A DISPLAY

BACKGROUND OF THE INVENTION

1. Field of the Invention

Embodiments of the present invention relate to a driving method of a display. More particularly, embodiments relate to a method for digitally driving a display.

2. Description of Related Art

Recently, various flat panel displays having reduced weight and volume compared with cathode ray tubes (CRTs) have been developed. Flat panel displays include liquid crystal displays (LCDs), field emission displays (FEDs), plasma display panels (PDPs), and organic light emitting displays.

Organic light emitting displays make use of organic light emitting diodes (OLEDs) that emit light by re-combination of electrons and holes. The organic light emitting display has advantages of high response speed and small power consumption.

A pixel of a conventional organic light emitting display may include an OLED and a pixel circuit, coupled to a data line Dm and a scan line Sn, to control the OLED, i.e., the OLED may generate light of a predetermined luminance corresponding to an electric current from the pixel circuit.

When a scan signal is supplied to the scan line, the pixel circuit may control an amount of an electric current provided to the OLED corresponding to a data signal provided to the data line Dm. To achieve this, the pixel circuit may include a transistor and a storage capacitor. The transistor may be coupled between a first power supply and the OLED. The OLED may be between a second power supply and the pixel circuit. The transistor may control an amount of an electric current flowing from the first power supply ELVDD to the second power supply ELVSS through the OLED according to the voltage stored in the storage capacitor. However, because pixels of the conventional organic light emitting display express gradations using a voltage stored in the storage capacitor, exact expression of desired gradations may be difficult. In practice, using an analog drive, the pixels should express a plurality of gradations using a constant voltage to be stored in the storage capacitor. Thus, in the conventional organic light emitting display, accurate brightness difference between adjacent gradations may not be expressed.

Further, in the conventional organic light emitting display, threshold voltage and electron mobility of the transistor may vary between pixels due to a process deviation. When deviations of the threshold voltage and electron mobility in the transistor occur, each pixel may generate light of different gradations in response to the same gradation voltage. Thus, the conventional organic light emitting display may not display an image of uniform luminance.

SUMMARY OF THE INVENTION

Embodiments of the present invention are therefore directed to a method for driving a display, which substantially overcomes one or more of the problems due to the limitations and disadvantages of the related art.

It is therefore a feature of an embodiment of the present invention to provide a method for digitally driving a display having an increased emission time period.

It is yet another feature of an embodiment of the present invention to provide a method for digitally driving a display including a sub frame for expressing black.

It is therefore another feature of an embodiment of the present invention to provide a method for digitally driving a display that divides a most significant bit into at least two sub frames.

At least one of the above and other features and advantages of embodiments of the present invention may be realized by providing a method for driving a display, including (i) dividing one frame into more sub frames than a number of bits of data; (ii) dividing a time period of the one frame into a number of periods corresponding to a number of scan lines multiplied by the number of sub frames; (iii) setting a start position within the time period of the sub frames based on a bit weight of the data; (iv) obtaining remainders of the sub frames by dividing the start position of the sub frames by the number of sub frames; and (v) obtaining a line number of a scan line to which a scan signal is supplied based on the time period of the one frame, the start position of the sub frames, and the number of the sub frames.

BRIEF DESCRIPTION OF THE DRAWINGS

The above and other features and advantages of the present invention will become more apparent to those of ordinary skill in the art by describing in detail exemplary embodiments thereof with reference to the attached drawings, in which:

FIG. 6 illustrates one frame in a method for driving an organic light emitting display according to an embodiment of the present invention for eight bit data;

DETAILED DESCRIPTION OF THE INVENTION

Figure 1:
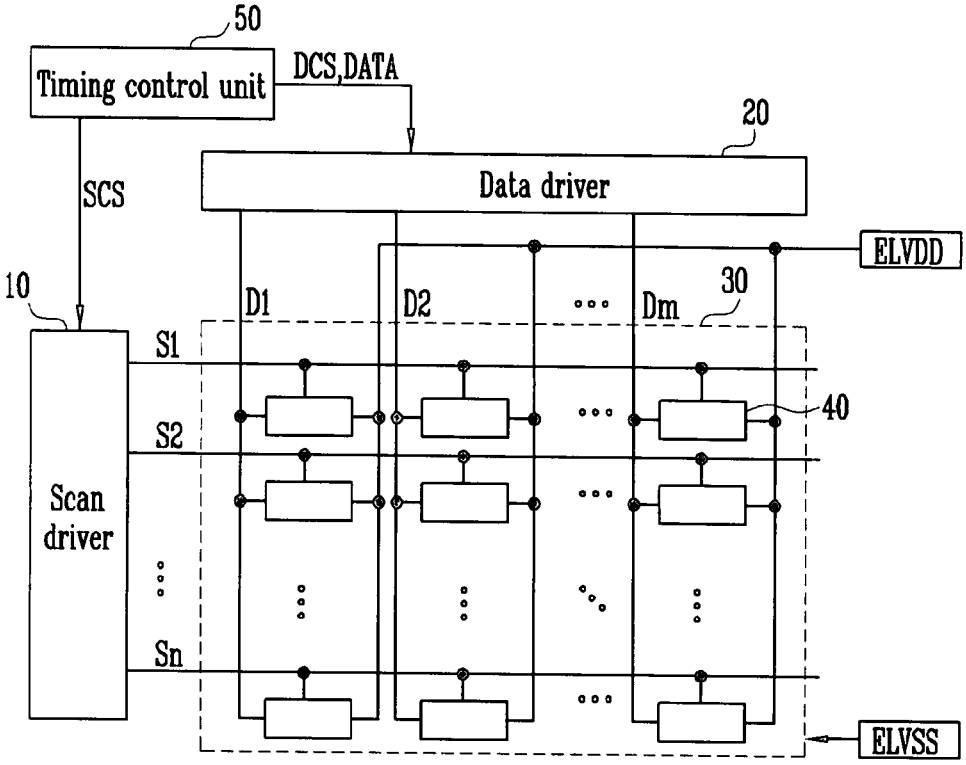
FIG. 1 illustrates an organic light emitting display according to an embodiment of the present invention.

Korean Patent Application No. 10-2006-0083144, filed on Aug. 30, 2006, in the Korean Intellectual Property Office, and entitled: "Driving Method Organic Light Emitting Display," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Hereinafter, example embodiments according to the present invention will be described with reference to the accompanying drawings, namely, FIG. 1 to FIG. 8. When one element is coupled to another element one element may be not only directly coupled to another element, but also may be indirectly coupled to another element via another element.

Further, irrelevant elements may be omitted for clarity. Also, like reference numerals refer to like elements throughout.

FIG. 1 illustrates an organic light emitting display according to an embodiment of the present invention With reference to FIG. 1, the organic light emitting display according to an embodiment of the present invention may include a pixel portion 30 having pixels 40, a scan driver 10, a data driver 20, and a timing control unit 50. The pixels 40 may be coupled to scan lines S1 through Sn and data lines D1 through Dm. The scan driver 10 may drive the scan lines S1 through Sn. The data driver 20 may drive the data lines D1 through Dm. The timing control unit 50 may control the scan driver 10 and the data driver 20.

The timing control unit 50 may generate a data driving signal DCS and a scan driving signal SCS corresponding to externally supplied synchronizing signals. The data driving signal DCS generated from the timing control part 50 may be provided to the data driver 20, and the scan driving signal SCS may be provided to the scan driver 10. Further, the timing control unit 50 may provide an externally supplied data DATA to the data driver 20.

The data driver 20 may supply a data signal to data lines D1 to Dm to every sub frame time period of a plurality of sub frame time periods included in one frame. The data signal may include a first data signal for a pixel 40 to emit light and a second data signal for a pixel 40 to not emit light. In other words, the data driver 20 may supply a first data signal or a second data signal, controlling emission or non-emission of the pixel, to data lines D1 to Dm every sub frame time period.

The scan driver 10 may sequentially provide a scan signal to scan lines S1 to Sn every sub frame period. When the scan signal is sequentially provided to the scan lines S1 to Sn, the pixels 40 are sequentially selected by lines, and the selected pixels 40 receive the first data signal or the second data signal from the data lines D1 to Dm.

The pixel portion 30 may receive power of the first power supply ELVDD and power of the second power supply ELVSS from the exterior, and may supply power to the pixels 40. After the pixels 40 receive the power of the first power supply ELVDD and the power of the second power supply ELVSS, when the scan signal is supplied, the pixels 40 may receive a data signal (the first data signal or the second data signal), and emit light or not according to the data signal. For example, when the scan signal is supplied, the pixels 40 having received the first data signal emit light during a corresponding sub frame period. In contrast to this, when the scan signal is supplied, the pixels 40 having received the second data signal do not emit light during a corresponding sub frame period. Of course, opposite logic may be used in accordance with a structure of the circuit controlling the pixels 40.

Figure 2:
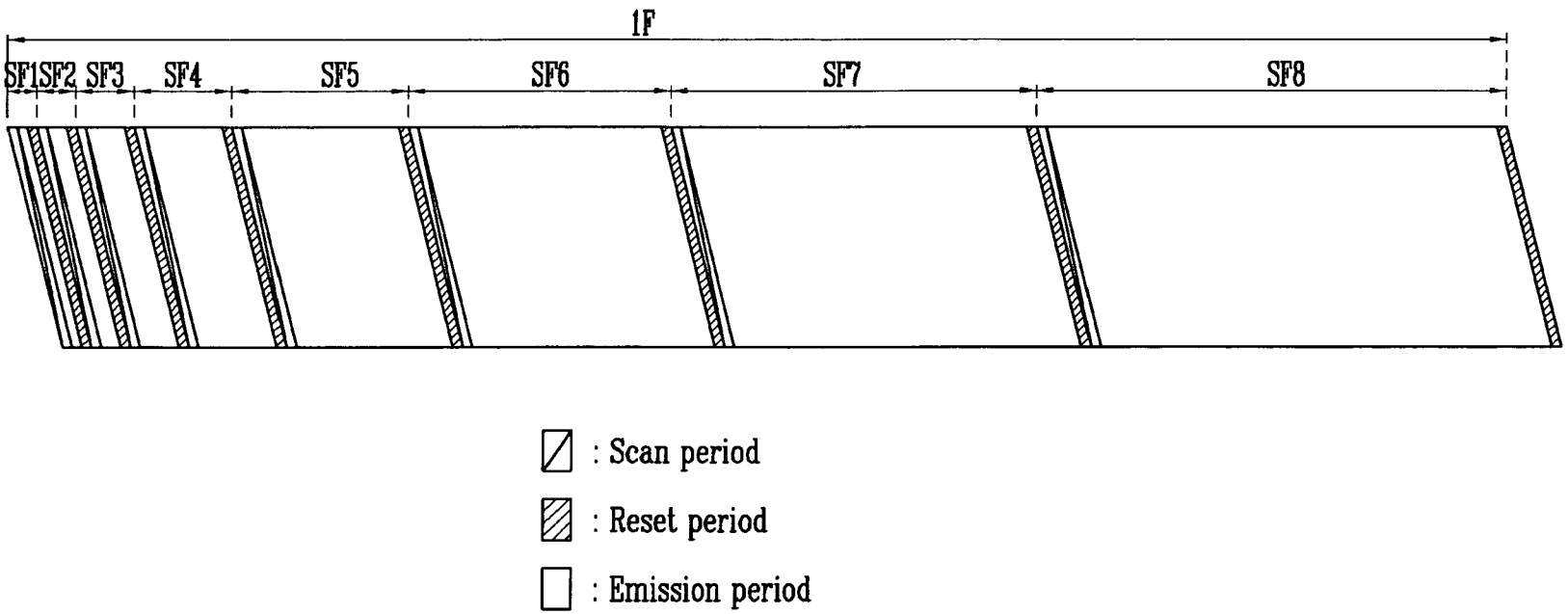
FIG. 2 illustrates one frame in a method for driving an organic light emitting display according to an embodiment of the present invention.

FIG. 2 illustrates a method for driving one frame in an organic light emitting display according to an embodiment of the present invention.

With reference to FIG. 2, one frame 1F of the present invention may be divided into a plurality of sub frames SF1~SF8 to be driven by digital drive. Here, the respective sub frames SF1~SF8 may be divided into a scan period to sequentially supply a scan signal, an emission period to cause pixels 40 having received the first data signal during the scan period to emit light, and a reset period to cause the pixels 40 to be changed into a non-emission state.

During the scan period, the scan signal may be sequentially provided to the scan lines S1 to Sn. Also during the scan period, the first data signal or the second data signal may be supplied to respective data lines D1 to Dm. That is, the pixels 40 may receive the first data signal or the second data signal.

The pixels 40 emit light or not during the emission period while maintaining the first data signal or the second data signal supplied during the scan period. That is, the pixels 40 having received the first data signal during the scan period are set in an emission state during a sub frame period, while the pixels 40 having received the second data signal are set in a non-emission state during a corresponding sub frame period.

Different emission periods may be set according to respective sub frames. For example, in order to display an image with 256 gradations, as shown in FIG. 2, one frame may be divided into eight sub frames SF1~SF8. Further, the emission period of respective sub frames SF1 to SF8 of the emission period may be increased at the rate of $2^n$ (n=0, 1, 2, 3, 4, 5, 6, 7) in the period. Namely, embodiments of the present invention may control emission or non-emission of pixels 40 based on respective sub frames to display an image of a predetermined gradation. In other words, embodiments of the present invention may express a predetermined gradation during one frame period using a sum of emission times by the pixels during the sub frame periods.

The one frame illustrated in FIG. 2 is merely one example of frames with which embodiments of the present invention may be employed. Thus, the present invention is not limited thereto. For example, one frame may be divided into more than ten sub frames, and an emission period of each sub frame may be variously set by a designer.

During the reset period, the pixels 40 may be set to a non-emission state. Additional wirings and transistors may be further included in each of the pixels 40 to achieve this reset state. Alternatively, the reset period may be eliminated.

Since the aforementioned digital drive expresses gradations using a turning-on or turning-off state of a transistor, an image of uniform luminance may be displayed. Furthermore, because the present invention expresses gradations using a time division, i.e., a digital drive, more exact gradations may be expressed as compared with expressing gradations using a constant voltage range, i.e., an analog drive.

However, even in the digital drive, since an emission time difference between a most significant bit and lower bits is typically large, a pseudo contour noise may occur. In other words, so as to express a gradation of 127, light may be emitted during the first to seventh sub frames SF1 to SF7, and not emitted during the eighth sub frame SF8. In order to express a gradation of 128, light may not be emitted during the first to seventh sub frames SF1 to SF7, and may be emitted during the eighth sub frame SF8. That is, in a digital drive, a predetermined time difference occurs upon expressing a specific gradation. The time difference may cause a pseudo contour noise to occur.

Figure 3:
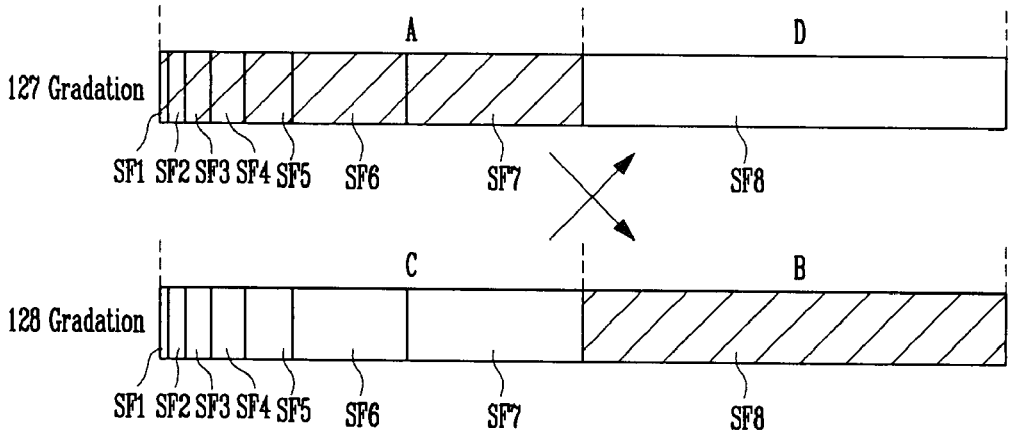
FIG. 3 illustrates an occurrence of pseudo contour noise during a digital drive.

In detail, as shown in FIG. 3, when a user observes "A" part expressing a gradation of 127 and "B" part expressing a gradation of 128 adjacent thereto, the user's retinas recognize them as a gradation of 255. Further, when a user observes "C" part expressing a gradation of 128 and "D" part expressing a gradation of 127 adjacent thereto, the user's retinas recognize them as a gradation of zero. Such a pseudo contour noise is a main factor deteriorating display quality in a digital drive.

Furthermore, during a scan period of a sub frame, a scan signal may be sequentially supplied to all the scan lines S1 to Sn. Because the supply period of the scan signal to the scan lines S1 to Sn does not contribute to emission, an emission time of the pixels 40 is shortened. In other words, when one frame includes eight sub frames, a scan signal is supplied to respective scan lines S1 to Sn eight times, shortening emission time.

In order to solve the aforementioned disadvantages, in an embodiment of the present invention, the scan signal may not be supplied to the scan lines S1 to Sn sequentially during the scan period. In other words, the scan lines S1 to Sn to which the scan signal is supplied may be set in a predetermined order, thereby maximizing emission time of the pixels 40.

Figure 4:
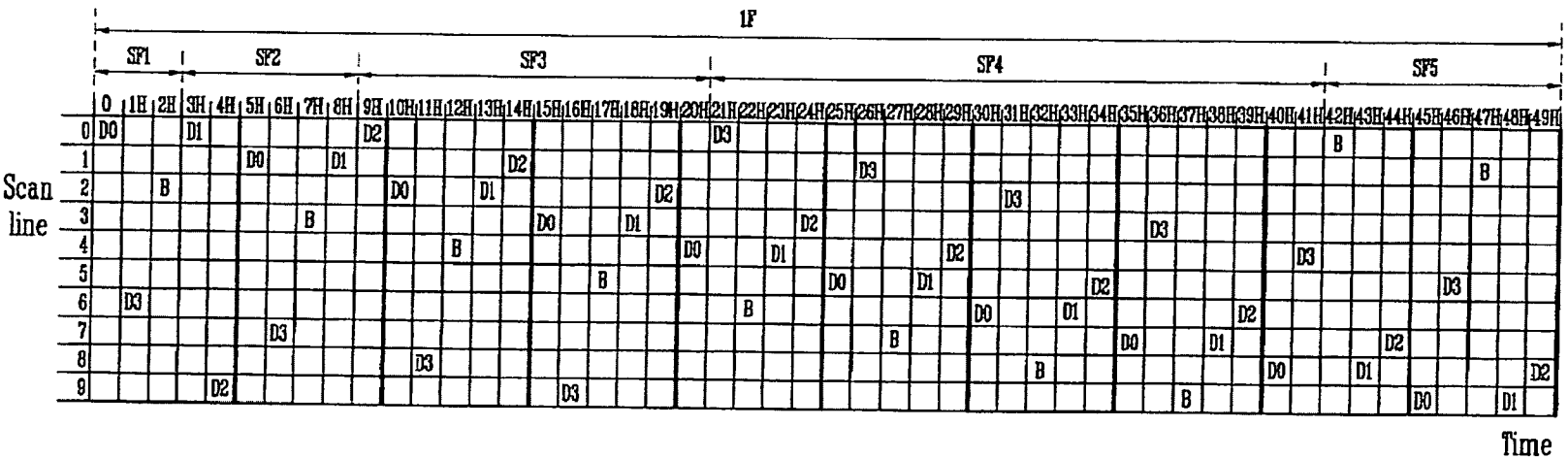
FIG. 4 illustrates one frame in a method for driving an organic light emitting display according to an embodiment of the present invention for four bit data.

FIG. 4 illustrates one frame in a method for driving an organic light emitting display according to an embodiment of the present invention. For purposes of explaining the one frame of FIG. 4, it is assumed that a data DATA is four bit data and a pixel portion of the display includes ten scan lines.

With reference to FIG. 4, one frame may be divided into, e.g., five sub frames. In other words, one frame in an embodiment of the present invention may include five sub frames, including four sub frames SF1 to SF4 contributing to emission corresponding to a data of four bits and one sub frame SF5 set in a non-emission state.

A time period of one frame may be divided into fifty horizontal periods 50H, obtained by multiplying the number of sub frames by the number of scan lines.

TABLE 1

| | D0 (SF1) | D1 (SF2) | D2 (SF3) | D3 (SF4) | B (SF5) |
|---|---|---|---|---|---|
| Start position | 0 | 3 | 9 | 21 | 42 |
| Emission time | 3 H | 6 H | 12 H | 21 H | 8 H |
| Remainder | 0 | 3 | 4 | 1 | 2 |
| Line number | 0 | 0 | 9 | 6 | 2 |

In Table 1, D0, D1, D2, and D3 indicate positions of one data DATA by bits. In other words, D0 represents a least significant bit (LSB) bit of the data DATA and D3 represents a most significant bit (MSB) bit thereof. In this case, the LSB bit determines emission or non-emission during a first sub frame SF1 having the lowest weight, whereas the MSB bit determines emission or non-emission during a fourth sub frame SF4 having the highest weight.

The start position represents a start position of the sub frame within the frame that has been divided into 50H time periods. Further, the emission time means an emission time of a corresponding sub frame. The remainder is a value that remains when the start position is divided by the total number of sub frames, e.g., five.

The following is an explanation of one frame in detail with reference to Table 1 and FIG. 4. In order to linearly express a gradation in each bit of the data DATA, the emission time of a sub frame may be doubled between adjacent sub frames. First, the first sub frame SF1 is emitted for a time period of 3H. Here, when a start position of the first sub frame SF1 is set as "0", the second sub frame SF2 starts from a time of 3H of one frame period and is emitted for a time period of 6H.

In addition, the third sub frame SF3 starts from a time of 9H of the one frame period and is emitted for a time period of 12H. The fourth sub frame SF4 starts from a time of 21H of the one frame period and is emitted for a time period of 21H. The fifth sub frame SF5 being a black frame starts from a time of 42H of the one frame period and is emitted for a time period of 8H.

In order to linearly express gradations, the fourth sub frame SF4 should be emitted for a time period of 24H. However, as shown in FIG. 4 and in Table 1, light is emitted only for a time period of 21H. In detail, when a start position of the fifth sub frame SF5 is set as 45H, an emission time of the fourth sub frame SF4 is set as 24H, allowing a linear gradation to be expressed. However, when a start position of the fifth sub frame SF5 is set as 45H, a remainder thereof (45/5) is "0". In this case, a remainder of the first sub frame SF1 and a remainder of the fifth sub frame SF5 become identical.

When the remainder of the first sub frame SF1 and the remainder of the fifth sub frame SF5 become identical, data may be simultaneously supplied. In other words, in this embodiment of the present invention, as shown in FIG. 4, one frame is divided into time periods of 50H, and light is emitted while a scan signal is supplied to one scan line every 1H time period. However, when remainders of sub frames included in one frame are identical, a scan signal may be supplied to two scan lines during a specific 1H time period.

When a start position of the fifth sub frame SF5 is set as 44, a remainder thereof is identical to that of the third sub frame SF3. Further, when a start position of the fifth sub frame SF5 is set as 43, a remainder thereof is identical to that of the second sub frame SF2. Accordingly, in the embodiment of the present invention, the start position of the fifth sub frame SF5 is set as 42 so that a remainder thereof is different from each remainder of other sub frames SF1 to SF4. Moreover, in the embodiment of the present invention, an emission time of the first sub frame SF1 corresponding to the LSB bit may be set as an odd number (3H in Table 1). In order to not have identical remainders in the sub frames SF1 to SF5, the emission time of the first sub frame SF1 corresponding to the LSB bit may be set as an odd number.

In this embodiment of the present invention, an emission time Tbsf of a blank sub frame SF5 may be determined in accordance with a time Tf of the one frame and an emission time Tlsb of the LSB bit by the following equation 1.

$$Tbsf=Tf-Tlsb\times(2^n-1) \quad (1)$$

where n is the number of bits of the data DATA.

In Table 1 and FIG. 4, the time Tf of one frame is set as 50H, an emission time Tlsb of the LSB bit is set as 3H, and n is set as four. Thus, in this particular example, an emission time Tbsf of the blank sub frame would be set as 5H. However, an emission time Tbsf of the blank sub frame is set as 8H in Table 1 and FIG. 4. In other words, since a start position of the blank sub frame is adjusted so that there are no identical remainders, a predetermined difference may occur between the time Tbsf of the blank sub frame and a time calculated by equation 1. In this case, the start position of the blank sub frame may be adjusted so that the emission time Tbsf of the blank sub frame may be within a range centered on the time calculated by the equation 1 and varying by an amount equal to or less than the emission time Tlsb of the LSB bit. In this particular example, the emission time Tbsf of the blank sub frame may be adjusted within a range of 5H±3H.

After start positions and emission times of respective sub frames SF1 to SF5 have been determined, line numbers LN may be obtained in accordance with the time Tf of one frame, a start position Bsp of each bit, and the number of sub frames x by the following equation 2. Here, the line numbers LN indicate scan lines for receiving a scan signal and the function INT truncates any fractional part of the number.

$$LN=INT\{(Tf-Bsp)/x+1\} \quad (2)$$

In this particular example, the time Tf of one frame period is set as 50 and the number of frames is set as 5. Further, a start position of LSB bit D0 is set as "1". Here, because the time Tf of the one frame is set as 50, i.e., is not 49, a start position of the LSB bit D0 is set as 1 rather than 0, i.e., is adjusted by one. According to equation 2, a line number LN of the LSB bit D0 is ten.

Here, a scan line is set as a range from a zero-th scan line S0 to a ninth scan line S9, and accordingly a line number of ten corresponds to the zero-th scan line S0. That is, when the line numbers LN are obtained by equation 2, the same line number as the number of scan lines is reset as 0.

In the same manner, in accordance with equation 2, a line number of D1 bit, having a start position of four, is ten, and accordingly, the zero-th scan line S0 is selected. Furthermore, in accordance with equation 2, a line number of D2 bit, having an adjusted start position of ten, is nine, and a line number of D3 bit, having an adjusted start position of twenty-two, is six. In addition, a line number of a blank sub frame SF5, having an adjusted start position of forty-three, is two.

Figure 5:
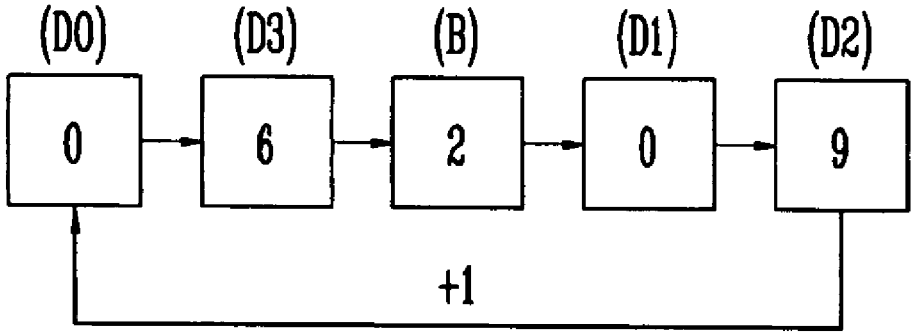
FIG. 5 illustrates a line number which is a supply order of a scan signal in FIG. 4.

FIG. 5 illustrates the line numbers obtained by the equation 2 arranged in an order of increasing remainders, i.e., the line numbers may be arranged as follows: 0→6→2→0→9. That is, the magnitude of remainders may be set in an order of the first sub frame SF1, the fourth sub frame SF4, the fifth sub frame SF5, the second sub frame SF2, and the third sub frame SF3. Here, weights of a data signal are arranged in an order of remainders as in the line numbers.

In detail, the scan signal is supplied in an order of a zero-th scan line S0, a sixth scan line S6, a second scan line S2, a zero-th scan line S0, and a ninth scan line S9 based on the line numbers. Furthermore, when the scan signal is supplied, the data signal is supplied to have weights in an order of remainders arranged in Table 1. In other words, when the scan signal is supplied to the zero-th scan line S0, a data signal having a weight of D0 bit is supplied. Accordingly, when the scan signal is supplied to the zero-th scan line S0, pixels having received the data signal emit light during a time period of 3H.

In addition, when the scan signal is supplied to the sixth scan line S6, a data signal having a weight of D3 bit is supplied, and the pixels emit light during a time period of 21H. Similarly, when the scan signal is supplied to the second scan line S2, the zero-th scan line S0, and the ninth scan line S9, data signals having weights of blank, D1 bit, and D2 bit, respectively.

After the scan signal is supplied to scan lines of the line numbers, the number of the line numbers is increased one by one. Accordingly, the line number is arranged in an order of 1→7→3→1→10. Here, because 10 is reset as 0, a real line number is determined in an order of 1→7→3→1→0, and the scan signal is supplied to the scan lines based on the determined line number. In this embodiment of the present invention, the aforementioned operation repeats by the number of the scan lines, here ten times, as shown in FIG. 5, thereby displaying an image of a predetermined gradation.

In this embodiment of the present invention, only scan signals corresponding to the number of the sub frames are supplied to respective scan lines during one frame, allowing the scan period to be dramatically shortened. In other words, this embodiment of the present invention may significantly reduce the scan period to significantly increase the emission period. Further, one frame may include a blank period in accordance with this embodiment of the present invention. Here, black may be expressed during the blank period, thereby enhancing display quality. In practice, when one frame includes a sub frame expressing black, display quality is improved.

While the data DATA has four bits in FIG. 5 and Table 1, in general, a data DATA used in an organic light emitting display has eight bits. Accordingly, a case where the data DATA has eight bits, i.e., where n=8, is explained referring to FIG. 6.

FIG. 6 illustrates one frame in an organic light emitting display according to an embodiment of the present invention when a data has eight bits. In this case, a time period of one frame 1F may be divided into a time period of 3200H (ten sub frames and 320 scan lines).

Table 2 indicates start positions of respective bits when the data DATA is 8 bit data.

TABLE 2

| | D1 (SF1) | D0 (SF2) | D2 (SF3) | D3 (SF4) | D4 (SF5) | B (SF6) | D7-1 (SF7) | D7-2 (SF8) | D6 (SF9) | D5 (SF10) |
|---|---|---|---|---|---|---|---|---|---|---|
| Start position | 0 | 22 | 33 | 77 | 165 | 341 | 736 | 1439 | 2144 | 2848 |
| Emission time | 22 H | 11 H | 44 H | 88 H | 176 H | 395 H | 703 H | 705 H | 704 H | 352 H |
| Remainder | 0 | 2 | 3 | 7 | 5 | 1 | 6 | 9 | 4 | 8 |
| Line No. | 0 | 318 | 317 | 313 | 304 | 286 | 247 | 177 | 106 | 36 |

With reference to FIG. 6 and Table 2, n=8 and one frame may be divided into ten sub frames. In detail, remaining bits of eight bits other than the MSB bit may be divided into respective one sub frame period, and the MSB bit is divided into two sub frame periods. Namely, the MSB bit may be divided into a seventh sub frame SF7 and an eighth sub frame SF8. Where the MSB bit is divided into two sub frames to be driven, an emission time difference may be decreased, thereby reducing a pseudo contour noise upon expressing gradations. In addition, the one frame may include a blank frame B, which may be used to express black.

In Table 2, D0 to D7-2 indicate positions (or weights) of the data DATA by bits. In other words, D0 represents LSB bit of the data DATA. Further, D7-1 and D7-2 may represent divided the MSB bit. Here, respective bits of the data DATA are not sequentially arranged. For example, a bit of D1 is present ahead of a bit of D0. The order can be variously set by a designer so that MSB bits may be divided.

An emission time by bits may be doubled in comparison with a previous bit so that gradation may be linearly expressed. A bit of D0 may be emitted during a time period of 11H, and a bit of D1 may be emitted during a time period of 22H. A bit of D2, a bit of D3, a bit of D4, a bit of D5, a bit of D6, a bit of D7-1, and a bit of D7-2 may be emitted during time periods of 44H, 88H, 176H, 352H, 704H, 703H, and 705H, respectively. Here, a sum of an emission time of D7-1 bit and an emission time of D7-2 bit may be twice that of D6 bit, which is 1408H, and the individual emission times D7-1 and D7-2 bits may be centered around the half the sum, here above and below half the sum by one. Moreover, the blank period may be determined as 395H in accordance with equation 1. Here, the blank period may be adjusted by an emission time ±11H of the LSB bit.

In FIG. 6 and Table 2, a time of one frame is set as 3200H, and the number of sub frames is set as ten. Further, a start position of D1 bit is set as "1". That is, because the time of one frame is set as 3200, a start position of D1 bit is set as 1 rather than 0.

Figure 7:
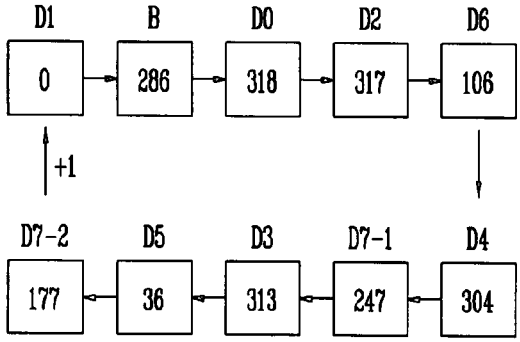
FIG. 7 illustrates a line number which is a supply order of a scan signal in FIG. 6.
Figure 8:
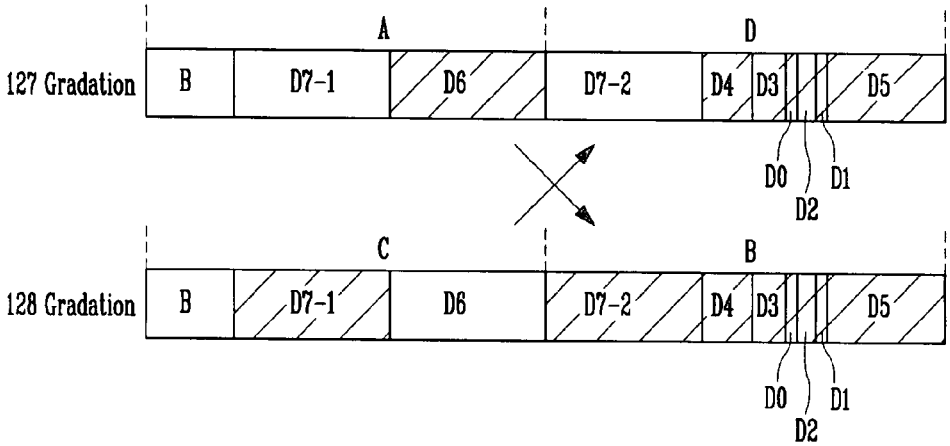
FIG. 8 illustrates a procedure for minimizing pseudo contour noise when dividing and driving a MSB bit of a data.

In accordance with equation 2, line numbers of respective bits may be determined to be 0, 318, 317, 313, 304, 286, 247, 177, 106, and 36. When the obtained line numbers are arranged in a magnitude order of remainders, as shown in FIG. 7, they are set in an order of 0→286→318→317→106→304→247→313→36→177. Here, weights of the data DATA are arranged in an order of remainders as in the line numbers.

In detail, the scan signal may be supplied in an order of a zero-th scan line S0, a 286-th scan line S286, a 318-th scan line S318, a 317-th scan line S317, a 106-th scan line S106, a 304-th scan line S304, a 247-th scan line S247, a 313-th scan line S313, a thirty sixth scan line S36, and a 177-th scan line S177 based on the line numbers. Furthermore, the data signal may be supplied to have weights in an order of remainders in Table 2.

In other words, when the scan signal is supplied to the zero-th scan line S0, a data signal (emission period of 22H) having a weight of D1 bit is supplied. Further, when the scan signal is supplied to the 286-th scan line S286, a data signal (emission period of 395H) having a weight of the blank period is supplied. In the same manner, the scan signal is supplied to scan lines in an order of the 318-th scan line S318, the 317-th scan line S317, the 106-th scan line S106, the 304-th scan line S304, the 247-th scan line S247, the 313-th scan line S313, the thirty sixth scan line S36, and the 177-th scan line S177, data signals having weights of D0, D2, D6, D4, D7-1, D3, D5, and D7-2 are supplied, respectively.

After the scan signal is supplied to scan lines of the line numbers, the number of the line numbers may be increased by one. Accordingly, the line numbers is arranged in an order of 1→287→319→318→107→305→248→314→37→178. When a line number exceeds 320, it is reset as 0. In the present invention, the aforementioned operation may be repeated by the number of the scan lines, thereby displaying an image of a predetermined gradation.

On the other hand, in the present invention, various forms of data bits (or weights of sub frames) may be arranged. For example, a data weight of one frame may be arranged as illustrated in Table 3.

TABLE 3

| | B (SF1) | D7-1(SF2) | D6 (SF3) | D7-2 (SF4) | D4 (SF5) | D3 (SF6) | D0 (SF7) | D2 (SF8) | D1 (SF9) | D5 (SF10) |
|---|---|---|---|---|---|---|---|---|---|---|
| Start position | 0 | 394 | 1095 | 1799 | 2507 | 2638 | 2771 | 2782 | 2826 | 2848 |
| Emission time | 394 H | 701 H | 704 H | 708 H | 176 H | 88 H | 11 H | 44 H | 22 H | 352 H |

In Table 3, in order to reduce a pseudo contour noise, the MSB bit may be divided into two sub frames to be driven. As shown in Table 3, the two sub frames may be have emission times above and below the emission time for the sub frame of the preceding weight, but a sum thereof may not be equal to twice that of the sub frame of the preceding weight, e.g., the D6 bit. For example, the emission time of the blank period B may be reduced compared with Table 2 and the emission time of the D7-2 bit may be increased.

In detail, when a gradation of 127 is expressed, D6, D4, D3, D2, D1, and D5 bits may be emitted. Further, when a gradation of 128 is expressed, bits of D7-1 and D7-2 may be emitted. As shown in FIG. 9, when a user observes "A" part expressing a gradation of 127 and "B" part expressing a gradation of 128 adjacent thereto, the user's retinas recognize them as a gradation of 128. Further, when a user observes "C" part expressing a gradation of 128 and "D" part expressing a gradation of 127 adjacent thereto, the user's retinas recognize them as a gradation of about 127. That is, embodiments of the present invention may divide the MSB bit into two sub frames to be driven, thereby minimizing a pseudo contour noise.

As is evident from the above explanation, in a method for driving an organic light emitting display according to embodiments of the present invention, the number of scan signals corresponding to the number of sub frames are supplied to respective scan lines, so that emission time of pixels may be significantly increased. Furthermore, embodiments of the present invention may improve the display quality by inserting a sub frame expressing black in one frame period. In addition, embodiments of the present invention may divide the MSB bit into two sub frames to be driven to minimize an emission time difference, thereby reducing a pseudo contour noise.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A method for driving a display, comprising:

(i) dividing one frame into more sub frames than a number of bits of data to be displayed;

(ii) dividing a time period of the one frame into a number of periods corresponding to a number of scan lines multiplied by the number of sub frames;

(iii) setting a start position of the sub frames within the time period based on a bit weight of the data;

(iv) obtaining remainders of the sub frames by dividing the start position of the sub frames by the number of sub frames; and (v) obtaining a line number of a scan line to which a scan signal is supplied based on the time period of the one frame, the start position of the sub frames, and the number of the sub frames, wherein the line number LN is obtained by a following equation:

$$LN=TRUNC\{(Tf-Bsp)/x+1\}$$

where Tf is an emission time of the one frame, Bsp is a start position of each and x is the total number of sub frames in the frame.

2. The method as claimed in claim 1, wherein dividing the one frame includes dividing a most significant bit of the data into at least two sub frames to express gradations.

3. The method as claimed in claim 2, wherein one of the sub frames has an emission time of more than half of an original emission time for the most significant bit and another of the sub frames has an emission time of less than half the original emission time.

4. The method as claimed in claim 1, wherein dividing the one frame includes providing a blank sub frame.

5. The method as claimed in claim 4, wherein the blank sub frame expresses black.

6. A method for driving a display, the method comprising:

(i) dividing one frame into more sub frames than a number of bits of data to be displayed, dividing the one frame including providing a blank sub frame;

(ii) dividing a time period of the one frame into a number of periods corresponding to a number of scan lines multiplied by the number of sub frames;

(iii) setting a start position of the sub frames within the time period based on a bit weight of the data;

(iv) obtaining remainders of the sub frames by dividing the start position of the sub frames by the number of sub frames; and (v) obtaining a line number of a scan line to which a scan signal is supplied based on the time period of the one frame, the start position of the sub frames, and the number of the sub frames, wherein an emission time Tbsf of the blank sub frame is adjusted within a range obtained by adding or subtracting a predetermined value to or from an emission time Tlsb of a least significant bit of the data by a following equation:

$$Tbsf=Tf-Tlsb\times(2^n-1)$$

where n represents the number of bits of data and Tf is an emission time of the one frame.

7. The method as claimed in claim 6, wherein the predetermined value is up to the emission time Tlsb of the least significant bit.

8. The method as claimed in claim 1, wherein an emission time of a least significant bit of the data of the one frame time period is set as an odd number of periods.

9. The method as claimed in claim 1, wherein an emission order of the data by bits is intermittently set during the one frame time period.

10. The method as claimed in claim 1, wherein the start position is set so that respective remainders of the sub frames are different from each other.

11. The method as claimed in claim 6, wherein the line number LN is obtained by a following equation:

$$LN=TRUNC\{(Tf-Bsp)/x+1\}$$

where Tf is an emission time of the one frame, Bsp is a start position of each and x is the total number of sub frames in the frame.

12. The method as claimed in claim 1, wherein the line number is set as "0" when the line number is set to be identical with the number of scan lines.

13. The method as claimed in claim 1, further comprising:

arranging the line numbers in an order of the remainders; and supplying the scan signal to the scan lines according to the arranged order.

14. The method as claimed in claim 13, further comprising supplying a data signal having a bit weight according the order of the remainders when the scan signal is supplied.

15. The method as claimed in claim 1, further comprising increasing the line numbers by one after the scan line is supplied to the line number.

16. The method as claimed in claim 15, further comprising supplying the number of scan signals only to the respective scan lines corresponding to the number of sub frames during the one frame time period.

17. The method as claimed in claim 15, wherein, when a line number equals or exceeds the number of scan lines, setting that line number to zero.

18. The method as claimed in claim 1, wherein an emission time of a current bit is approximately double that of a previous bit.

19. The method as claimed in claim 1, wherein a progression from least significant bit to most significant bit is approximately geometric.

20. The method as claimed in claim 1, wherein the display is an organic light emitting display.

* * * * *